United States Patent [19]

Adey

[11] Patent Number: 4,457,277

[45] Date of Patent: Jul. 3, 1984

[54] FUEL INJECTION PUMPING APPARATUS

[75] Inventor: Anthony J. Adey, Gravesend, England

[73] Assignee: Lucas Industries plc, Birmingham, England

[21] Appl. No.: 551,507

[22] Filed: Nov. 14, 1983

Related U.S. Application Data

[63] Continuation-in-part of Ser. No. 368,160, Apr. 14, 1982, abandoned.

[30] Foreign Application Priority Data

Apr. 23, 1981 [GB] United Kingdom ..... 8112552

[51] Int. Cl.[3] ..... F04B 49/00; F04B 19/22

[52] U.S. Cl. ..... 123/387; 123/450; 417/221; 417/462

[58] Field of Search ..... 123/198 D, 198 DB, 387, 123/388, 450; 417/218, 219, 221, 462

[56] References Cited

U.S. PATENT DOCUMENTS

| | | | |
|---|---|---|---|
| 3,485,225 | 12/1969 | Bailey | 123/450 |
| 3,861,833 | 1/1975 | Salzgeber | 417/462 |
| 3,951,117 | 4/1976 | Perr | 123/450 |
| 4,116,186 | 9/1978 | Drori | 123/450 |
| 4,292,012 | 9/1981 | Brotherston | 417/402 |
| 4,358,255 | 11/1982 | Brotherston | 417/462 |
| 4,397,615 | 8/1983 | Mowbray | 123/450 |

*Primary Examiner*—Charles J. Myhre
*Assistant Examiner*—Carl Stuart Miller

[57] ABSTRACT

A fuel injection pumping apparatus for supplying fuel to an internal combustion engine includes a rotary distributor member which is also axially movable to determine the amount of fuel supplied by the apparatus. Fluid under pressure is supplied to the chamber to move the distributor member axially against the action of a spring and valve means is provided to control the pressure. The valve means includes a first member in the form of a spool and a second member in the form of a sleeve. The sleeve is coupled by linkage to the distributor member and the position of the spool is determined by a speed responsive governor. A land on the spool cooperates with a port to control the flow of fluid to the chamber. A groove on the spool and a port register to allow fuel flow to a pumping chamber but move out of register to halt fuel flow if the spool should move with increasing speed without there being a corresponding movement of the distributor member and sleeve to reduce the fuel delivered by the apparatus.

4 Claims, 1 Drawing Figure

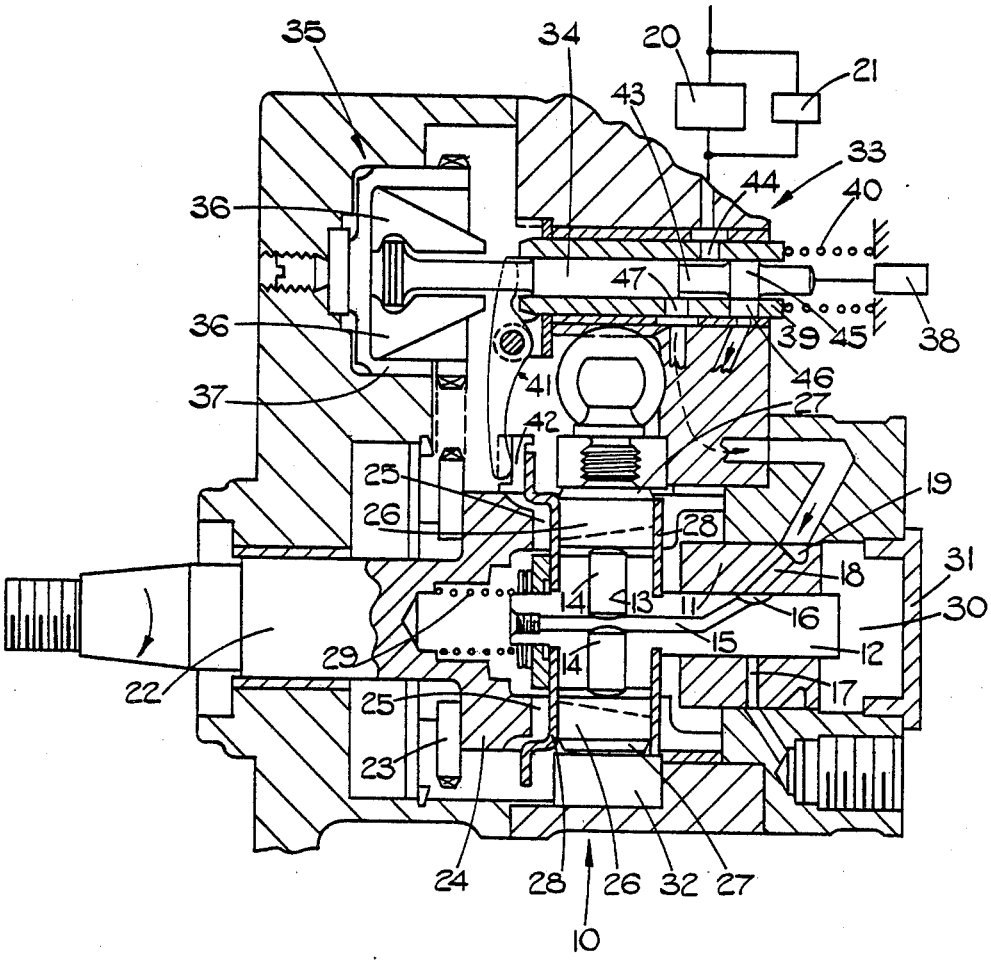
35
34
20
21
43
33
44
40
36
47
36
39
45
38
37
41
46
27
42
25
19
26
28
18
31
14
13
11
16
30
29
15
12
22
14
17
25
23
24
28
26
32
27
10

FUEL INJECTION PUMPING APPARATUS

This application is a continuation-in-part of application Ser. No. 368,160, filed Apr. 14, 1982 now abandoned.

This invention relates to a fuel injection pumping apparatus for supplying fuel to an internal combustion engine and comprises an injection pump operable in timed relationship with an associated engine, a fuel quantity control member movable to vary the amount of fuel delivered by the pump, a hydraulic servo mechanism for positioning said member, said servo mechanism including valve means comprising first and second members movable relative to each other, port means defined by the members and through which liquid under pressure can flow to said chamber, speed responsive means for adjusting the setting of the first of said members and a linkage extending between the second of said members and the control member whereby for a given change in the setting of said first member. the pressure in said chamber will vary and the control member will move an amount determined by the change in the setting of said first member.

With an apparatus of the kind specified there is a danger that the fuel control member may not move axially in response to movement of the first member due for example, to a physical restraint on the fuel control member or to the fact that there is inadequate fluid pressure available. Such a situation could be dangerous in that it would be possible for the engine to over-speed and therefore suffer damage or speed up to a value which could be dangerous for the vehicle with which it is associated.

The object of the present invention is to provide an apparatus in a form in which the risk of over-speeding of the engine is minimized.

According to the invention in an apparatus of the kind specified said first and second members define further port means through which fuel flows to said pump from a source of fuel under pressure, said further port means in the event that the second member remains fixed due to lack of movement of the fuel control member, being closed by the action of said speed responsive means as the speed of the engine increases.

An example of an apparatus in accordance with the invention will now be described with reference to the accompanying drawing which is a sectional side elevation of the apparatus.

Referring to the drawing the apparatus comprises a multi-part body 10 which includes a sleeve 11 in which is mounted a rotary cylindrical distributor member 12. The distributor member projects from the sleeve and is provided with an outwardly extending transverse bore 13 in which is located a pair of pumping plungers 14. The bore communicates with an axial passage 15 which terminates in a delivery slot 16 formed on the periphery of the distributor member. The slot 16 registers in turn and as the distributor member rotates, with outlet ports 17 only one of which is shown, which communicate with the injection nozzles respectively of the associated engine. The slot 16 can also register with ports at the inner ends of inlet passages 18, these ports and the ports 17 being in the same radial plane. The passages 18 communicate with a circumferential groove 19 formed on the peripheral surface of the sleeve.

The groove 19 is in communication with the outlet of the fuel supply pump which for convenience is indicated at 20, the output pressure of the pump being controlled by a valve 21. The rotary part of the pump 20 is carried on a drive shaft 22 which is journalled in the body part and which in use is driven by the associated engine. The drive shaft carries a toothed wheel 23 and it includes an enlarged head portion 24 which surrounds the end of the distributor member which projects from the sleeve. The head portion defines a pair of slots 25 within which are located shoes 26. At their inner ends the shoes engage the outer ends of the plungers respectively and at their outer ends the shoes are provided with grooves to receive rollers 27. The slots 25 also accommodate drive plates 28 which are connected to the distributor member and the drive plates act to transmit rotary motion from the drive shaft to the distributor member.

The internal surface of the enlarged portion 24 of the shaft is flared outwardly and the shoes 26 are provided with complementary surfaces whereby the extent of outward movement of the plungers 14 when the apparatus is in use, depends upon the axial setting of the distributor member. Formed in the drive shaft is a chamber in which is located a coiled compression spring 29 which acts to bias the distributor member towards the right as shown in the drawing. A chamber 30 is defined in part by the end surface of the distributor member and in part by a cover 31. The fluid pressure in the chamber 30 can be controlled to control the axial position of the distributor member.

The rollers 27 engage the internal peripheral surface of an angularly adjustable cam ring 32. On the internal peripheral surface of the cam ring is formed a plurality of pairs of cam lobes which are positioned such that inward movement of the plungers 14 can only take place while the slot 16 is in communication with an outlet port 17. When the slot moves into communication with an inlet passage 18 fuel is supplied to the bore 13 and the plungers are moved outwardly, the extent of such movement being limited by the abutment of the surfaces on the shoes with the flared surface defined by the enlarged portion 24 of the drive shaft.

The pressure in the chamber 30 acts upon the distributor member to bias the distributor member against the action of the spring 29 in a direction to reduce the amount of fuel delivered to the engine. Fuel is admitted to the chamber 30 from the outlet of the supply pump 20 by way of a port which forms part of a valve means generally indicated at 33. The valve means includes a spool 34 one end of which is acted upon by a centrifugal weight mechanism 35 and which includes weights 36 carried within a cage 37 arranged to be driven from the drive shaft 22. As illustrated, the cage is provided with a toothed periphery which is engaged by a drive belt which extends around the aforesaid gear wheel 23. Alternatively the gear wheel and the toothed portion of the cage may be connected by means of an idler gear. A force is applied to the other end of the spool to oppose movement of the spool by the weight mechanism. This force is generated by a spring pack generally indicated at 38 and the force exerted by the spring pack may be adjusted by means of a control moveable by the operator and connected for example to the throttle pedal of a vehicle of which the associated engine forms part.

Also forming part of the valve means 33 is an axially slidable sleeve 39 within which the spool 34 is slidable. The sleeve 39 is biassed in one direction by a light spring 40 and is movable in the opposite direction by means of a pivotal lever 41 the other end of which engages a pad 42 engaging against a flange formed on one of the drive plates 28. As the distributor member is moved axially the sleeve 39 will also partake of axial movement and in the particular example, this movement will be in the opposite direction to that of the distributor member. The spring 40 could be made strong enough to provide the biassing force for the distributor member in which case the spring 29 need not be provided.

The spool defines a circumferential groove 43 which by way of a port 44 formed in the sleeve 39, is in constant communication with the outlet of the supply pump 20. The spool also defines a land 45 which controls a port 46 formed in the sleeve 39 and communicating with the chamber 30. As shown in the drawing the port 46 is closed but if the spool is moved towards the right relative to the sleeve, the port 46 will be opened to the circumferential groove 43 and fuel under pressure will flow into the chamber 30 thereby causing movement of the distributor member towards the left and reducing the amount of fuel delivered to the engine. As the distributor member moves so also does the sleeve and the movement is such as to close the port 46. A follow up servo system is therefore provided. If the spool moves towards the left due for example to a reduction in the speed of the engine or an increase in the force exerted by the spring pack, then the port 46 will be uncovered by the land 45 to a drain and fuel can escape from the chamber 30 thereby permitting the distributor member to move towards the right and the sleeve towards the left to reclose the port 46. The axial position of the spool as previously stated, depends upon the speed of the associated engine and also the demand signal applied by way of the spring pack 38.

In the event that the distributor member is unable to move due to partial seizure or due to insufficient fuel pressure then with increasing engine speed although the port 46 is uncovered to the groove 43, no axial movement of the distributor member will take place and hence the normal governing action which is effected by the weight mechanism 35 in conjunction with the spring pack, will not be effective. The engine speed could therefore attain a dangerous value particularly if the driver of the vehicle disengages the clutch.

In order to avoid this difficulty the flow of fuel to the circumferential groove 19 from the outlet of the supply pump 20 is taken by way of a further port 47 formed in the sleeve 39 and which is controlled by the main portion of the spool, the port 47 normally being uncovered to the circumferential groove 43 such that there is substantially no restriction to the flow of fuel. In normal operation the control of the quantity of fuel supplied to the associated engine is effected by altering in the manner described, the axial position of the distributor member. If however the distributor member should stick then if an increase in the engine speed occurs, the port 47 will tend to be closed upon axial movement of the spool 34 with increasing speed. The flow of fuel to the groove 19 and hence to the bore 13 will therefore be interrupted. The operator of the vehicle can effect some control over the amount of fuel supplied to the engine in this situation by varying the force exerted by the spring pack but it will be understood that the maximum amount of fuel which can be supplied to the engine will be determined by the axial position of the distributor member at that time. Hence while the engine can still be operated, the maximum power may be limited. When the apparatus is functioning normally then the only occasion when the port 47 may be closed is when the force exerted by the spring pack is suddenly reduced as for example when the driver suddenly releases the throttle pedal. This situation will only prevail for as long as it takes the distributor member to assume the desired fuel position.

I claim:

1. A fuel injection pumping apparatus for supplying fuel to an internal combustion engine comprising an injection pump including a bore and a plunger movable therein and operable in timed relationship with an associated engine, a fuel quantity control member movable by fuel under pressure in a chamber to vary the amount of fuel delivered by the pump, said quantity control member being arranged so that with increasing pressure in the chamber the quantity of fuel supplied by the apparatus is decreased, a hydraulic feedback servo mechanism for positioning said member, said servo mechanism including valve means comprising first and second axially movable members, port means defined by the members and through which liquid under pressure can flow to said chamber, speed responsive means for adjusting the setting of the first of said members and a linkage extending between the second of said members and the control member, said linkage acting to transmit movement of said control member to the second of said members, whereby for a given change in the setting of said first member the size of said port means will vary to alter the pressure in said chamber and the control member and the second member will move an amount determined by the change in the setting of said first member, characterized in that said first and second members define further port means through which fuel flows to said bore from a source of fuel under pressure, said further port means, in the event that the second member remains fixed due to lack of movement of the control member, being closed by movement of the first member under the action of said speed responsive means as the speed of the engine increases.

2. A fuel injection pumping apparatus for supplying fuel to an internal combustion engine comprising a body part, a rotary distributor member located in the body part, an outwardly extending bore formed in the distributor member and a plunger slidable therein, means for feeding fuel to said bore to move the plunger outwardly during a filling stroke of the apparatus, a delivery passage communicating with the bore and arranged to register with an outlet port in the body part during a delivery stroke of the apparatus, a cam for imparting inward movement to the plunger to effect delivery of fuel, stop means for limiting the outward movement of the plunger, said stop means being arranged so that the amount of fuel delivered during the delivery stroke depends upon the axial setting of the distributor member, resilient means biasing the distributor member in one axial direction, a variable volume chamber defined in part by an outwardly extending face of the distributor member or a part movable therewith, valve means for controlling the pressure of liquid in said chamber, said pressure acting on said outwardly extending face to determine the axial setting of the distributor member, said valve means including first and second members movable relative to each other, port means defined by the members and through which liquid under pressure can flow to said chamber, speed responsive means for adjusting the setting of the first of said members and a linkage extending between the second of said members and the distributor member, said linkage acting to transmit movement of said distributor member to the second of said members, whereby for a given change in the setting of said first member the size of said port means will vary to alter the pressure in said chamber and the distributor member and the second member will move an amount determined by the change in the setting of said first member, characterized in that said first and second members define further port means through which fuel flows to said bore from a source of fuel under pressure, said further port means, in the event that the second member remains fixed due to lack of movement of the distributor member, being closed by movement of the first member under the action of said speed responsive means as the speed of the engine increases.

3. An apparatus according to claim 2, in which said first member is in the form of a spool slidable within a sleeve constituting said second member, said further port means comprising a groove in said spool and a port in said sleeve.

4. An apparatus according to claim 3, in which the liquid under pressure is fuel delivered by a low pressure supply pump which also supplies fuel to the bore.

* * * * *